US010819012B2

(12) United States Patent
Liu

(10) Patent No.: US 10,819,012 B2
(45) Date of Patent: Oct. 27, 2020

(54) ANTENNA AND MOBILE TERMINAL

(71) Applicant: Beijing Xiaomi Mobile Software Co., Ltd., Beijing (CN)

(72) Inventor: Jiarong Liu, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 47 days.

(21) Appl. No.: 16/354,564

(22) Filed: Mar. 15, 2019

(65) Prior Publication Data

US 2020/0036082 A1 Jan. 30, 2020

(30) Foreign Application Priority Data

Jul. 27, 2018 (CN) ..... 2018 1 0841024

(51) Int. Cl.
*H01Q 1/24* (2006.01)
*H01Q 5/50* (2015.01)
*H01Q 9/06* (2006.01)

(52) U.S. Cl.
CPC ..... *H01Q 1/243* (2013.01); *H01Q 5/50* (2015.01); *H01Q 9/06* (2013.01)

(58) Field of Classification Search
None
See application file for complete search history.

(56) References Cited

U.S. PATENT DOCUMENTS 9,728,854 B2 8/2017 Kim et al.
2013/0127673 A1 5/2013 Chang et al.
2016/0064820 A1 3/2016 Kim et al.
2017/0346159 A1* 11/2017 Xue ..... H01Q 5/314
2018/0212313 A1* 7/2018 Harper ..... H01Q 5/328
2018/0375209 A1* 12/2018 Su ..... H01Q 5/30
2019/0067821 A1* 2/2019 Kim ..... H01Q 7/00
2019/0207297 A1* 7/2019 Gu ..... H01Q 5/335

FOREIGN PATENT DOCUMENTS

CN 105337036 A 2/2016
CN 105811079 A 7/2016
CN 105811103 A 7/2016
CN 107181045 A 9/2017
(Continued)

OTHER PUBLICATIONS

Extended Search Report for European Application No. 19188095.4 from the European Patent Office, dated Nov. 18, 2019.
(Continued)

*Primary Examiner* — Jany Richardson
(74) *Attorney, Agent, or Firm* — Finnegan, Henderson, Farabow, Garrett & Dunner, L.L.P.

(57) ABSTRACT

An antenna applied to a mobile terminal, includes: a first sub-antenna; and a second sub-antenna. The mobile terminal includes a first metal frame and a second metal frame, a breaking joint being provided between a first end of the first metal frame and a first end of the second metal frame, a length of the first metal frame being within a range of a quarter wavelength of a specified band, and the length of the first metal frame being greater than a length of the second metal frame. The first sub-antenna and the second sub-antenna are formed based on the first metal frame and the second metal frame.

20 Claims, 8 Drawing Sheets

(56) References Cited

FOREIGN PATENT DOCUMENTS

| | | | |
|---|---|---|---|
| CN | 206532881 | U | 9/2017 |
| CN | 107331979 | A | 11/2017 |
| CN | 107369891 | A | 11/2017 |
| CN | 108232421 | A | 6/2018 |
| KR | 20120046962 | A | 5/2012 |
| KR | 20170130820 | A | 11/2017 |

OTHER PUBLICATIONS

Office Action dated Oct. 24, 2019, in counterpart Chinese Application No. 201810841024.8 and English translation thereof.
International Search Report in International Application No. PCT/CN2018/107045, dated Apr. 4, 2019.
First Office Action of the Korean application No. 10-2019-7023431, dated Feb. 26, 2020.
English version of International Search Report in the international application No. PCT/CN2018/107045, dated Apr. 4, 2019.

* cited by examiner

ANTENNA AND MOBILE TERMINAL

CROSS-REFERENCE TO RELATED APPLICATION

This application is based upon and claims priority to Chinese Patent Application No. 201810841024.8, filed on Jul. 27, 2018, the entire contents of which are incorporated herein by reference.

TECHNICAL FIELD

The present disclosure relates to the technical field of mobile terminals, and in particular to an antenna and a mobile terminal.

BACKGROUND

With the arrival of a 5G era, more and more bands are available for signal transmission, so that demands for antenna radiation in a mobile terminal are also increasing. For example, the antenna is required to be able to radiate signals in a low frequency millimeter wave band in 5G in addition to an existing band. The low frequency millimeter wave band is commonly known as a Sub-6 GHz band. However, with the rapid development of the mobile terminal technology, a screen-to-body ratio of the mobile terminal is increasing, and a number of devices having a metal structure internally is also increasing, thereby causing the decrease of a clearance area for designing the antenna inside the body of the mobile terminal. Therefore, at present, it is urgently necessary to design an antenna in a smaller clearance area to implement radiation of various band signals.

SUMMARY

According to a first aspect of the embodiments of the present disclosure, there is provided an antenna applied to a mobile terminal, wherein the mobile terminal includes a first metal frame and a second metal frame, a breaking joint is provided between a first end of the first metal frame and a first end of the second metal frame, the length of the first metal frame is within the range of a quarter wavelength of a specified band, and the length of the first metal frame is greater than the length of the second metal frame. The antenna includes a first sub-antenna and a second sub-antenna, wherein a feeding point located at a specified position of the first end of the first metal frame is coupled to a first end of a first capacitive device, a second end of the first capacitive device is coupled to a first end of a changeover switch, a second end of the changeover switch is coupled to one of a first end of a second capacitive device or a first end of an inductive device, each of a second end of the second capacitive device and a second end of the inductive device is coupled to a first ground point, and a second end of the first metal frame is coupled to a second ground point, so as to form the first sub-antenna; and a second end of the second metal frame is coupled to a third ground point, so as to form the second sub-antenna.

According to a second aspect of the embodiments of the present disclosure, there is provided a mobile terminal including: a first metal frame and a second metal frame, a breaking joint being provided between a first end of the first metal frame and a first end of the second metal frame, a length of the first metal frame being within a range of a quarter wavelength of a specified band, and the length of the first metal frame being greater than a length of the second metal frame, wherein a feeding point located at a specified position of the first end of the first metal frame is coupled to a first end of a first capacitive device, a second end of the first capacitive device is coupled to a first end of a changeover switch, a second end of the changeover switch is coupled to one of a first end of a second capacitive device or a first end of an inductive device, each of a second end of the second capacitive device and a second end of the inductive device is coupled to a first ground point, and a second end of the first metal frame is coupled to a second ground point, so as to form a first sub-antenna of the mobile terminal; and a second end of the second metal frame is coupled to a third ground point, so as to form a second sub-antenna of the mobile terminal.

It will be appreciated that the above general description and the following detail description are only exemplary and explanatory, and do not limit the present disclosure.

BRIEF DESCRIPTION OF THE DRAWINGS

The accompanying drawings herein are incorporated into and constitute a portion of the specification, illustrate the embodiments consistent with the present disclosure and, together with the description, serve to explain the principle of the present disclosure.

Drawing reference labels: 1: First metal frame; 2: second metal frame; 3: feeding point; 4: first capacitive device; 5: changeover switch; 6: second capacitive device; 7: inductive device.

DETAILED DESCRIPTION

Exemplary embodiments are described in detail below, and are illustrated in the accompanying drawings. The following description refers to the accompanying drawings in which the same numbers in different drawings represent the same or similar elements unless otherwise represented. Implementation manners described in the following exemplary embodiments do not represent all implementation manners consistent with the present disclosure. On the contrary, they are only examples of a device and a method consistent with some aspects of the present disclosure.

Before an antenna structure and a signal radiation principle provided by the embodiments of the present disclosure are described in detail, an application scenario involved in the embodiments of the present disclosure will be briefly introduced first.

At present, similar to a Time Division Long Term Evolution (TDD-LTE) and a Frequency Division Duplex Long Term Evolution (FDD-LTE) of a 4G era, a 5G technology at the present stage also has two development directions, namely, millimeter wave bands of Sub-6 GHz, and 6 GHz or above. In the two directions, the implementation of Sub-6 GHz is relatively easy and can follow the existing infrastructure of an operator, and the division of bands is also relatively clear. Therefore, over the next few years, the Sub-6 GHz band will become an important transitory technology of a 5G upgrade plan of the operator. The Sub-6 GHz bands may include bands n77, n78 and n79, such as 3.3 GHz to 3.6 GHz in the band n77 domestically issued to be used, and 4.8 GHz to 5 GHz in the band n79. This results in increasing demands for antenna radiating in mobile terminals. That is, the antenna is required to not only radiate a signal of the existing band including, for example, 2G, 3G or 4G, but also radiate a signal of the above Sub-6 GHz band. However, with the popularization and evolution of full screen and metal materials, a clearance area reserved in the mobile terminal for the antenna is more and more compact. Thus, it will be very difficult to radiate a signal of a Sub-6 GHz band on the basis of radiating the signal of the existing band.

To this end, the embodiments of the present disclosure provide an antenna. The antenna may implement radiation of signals of the existing band and a Sub-6 GHz band without the addition of a device such as a switch and antenna branches, so as to solve a contradiction between the increasingly difficult antenna design and the increase of band demands.

Figure 1:
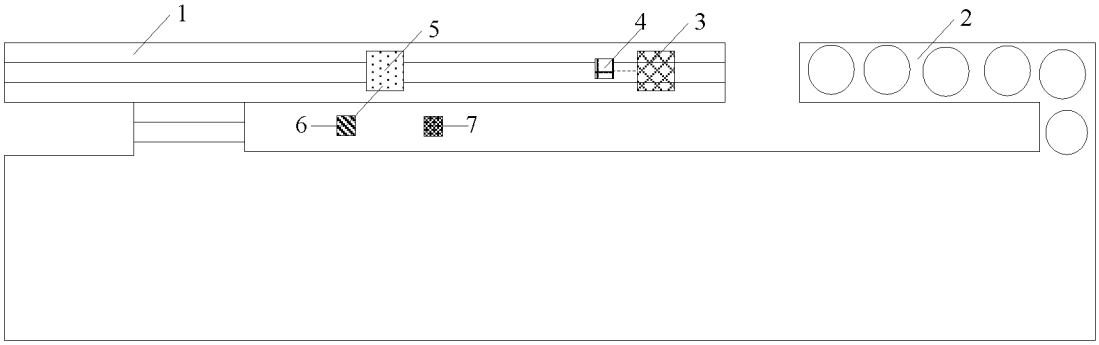
FIG. 1 is a schematic diagram of an antenna according to an exemplary embodiment.

The following will introduce the antenna provided by the embodiments of the present disclosure in detail with reference to the drawings. Referring to FIG. 1, FIG. 1 is a schematic diagram of an antenna according to an exemplary embodiment. The antenna is applied to a mobile terminal. The mobile terminal mainly includes a first metal frame 1 and a second metal frame 2. A breaking joint is provided between a first end of the first metal frame 1 and a first end of the second metal frame 2. The length of the first metal frame 1 is within the range of a quarter wavelength of a specified band, and the length of the first metal frame 1 is greater than the length of the second metal frame 2.

The first metal frame 1 includes a feeding point 3, the feeding point 3 being located at a specified position of the first end of the first metal frame 1. The feeding point 3 is coupled to a first end of a first capacitive device 4, a second end of the first capacitive device 4 is coupled to a first end of a changeover switch 5, a second end of the changeover switch 5 is coupled to one of a first end of a second capacitive device 6 or a first end of an inductive device 7, each of a second end of the second capacitive device 6 and a second end of the inductive device 7 is coupled to a first ground point, and a second end of the first metal frame 1 is coupled to a second ground point, so as to form a first sub-antenna. A second end of the second metal frame 2 is coupled to a third ground point, so as to form a second sub-antenna.

Figure 2:
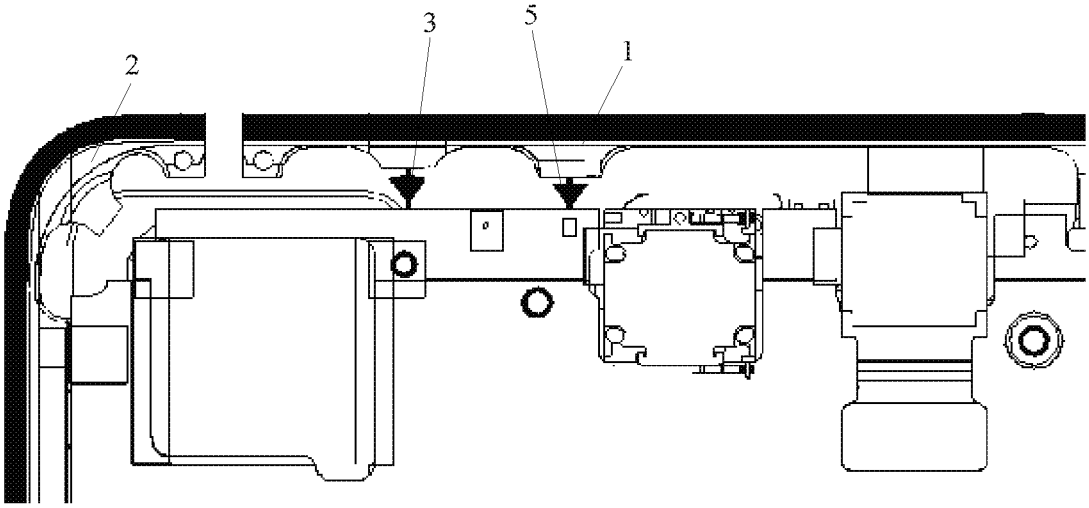
FIG. 2 is a schematic diagram of a front view of an antenna according to an exemplary embodiment.
Figure 3:
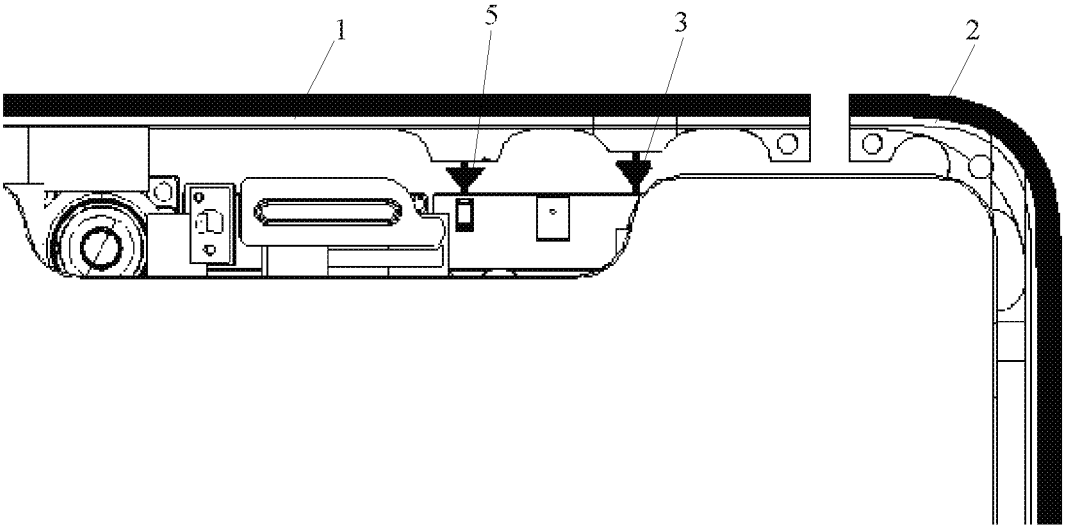
FIG. 3 is a schematic diagram of a back view of an antenna according to an exemplary embodiment.

Referring to FIG. 2 and FIG. 3, FIG. 2 and FIG. 3 are schematic diagrams of a front view and a back view of the antenna on the mobile terminal, respectively. In the embodiment, the antenna is designed by using the existing first metal frame 1 and second metal frame 2 of the mobile terminal. Thus, space occupied by the antenna may be saved without the addition of other devices or antenna branches. That is, an antenna may be designed in a smaller clearance area by using the first metal frame 1 and the second metal frame 2, and radiation of various band signals is implemented by using the antenna.

In some embodiments, both the first metal frame 1 and the second metal frame 2 may be a bottom frame of the mobile terminal. In some other embodiments, both the first metal frame 1 and the second metal frame 2 may be a top frame of the mobile terminal, or either of the first metal frame 1 and the second metal frame 2 may be the top frame of the mobile terminal while the other one is the bottom frame of the mobile terminal, which is not limited in the embodiments of the present disclosure.

The above specified position for the feeding point 3 may be customized by a user according to actual demands, that is, in the embodiments of the present disclosure, the feeding point 3 is disposed at a tail end, close to the breaking joint, of the first metal frame 1, and the feeding point 3 is coupled to the first end of the first capacitive device 4. In addition, in order to implement radiation of different band signals, the second end of the first capacitive device 4 is coupled to the first end of the changeover switch 5, and the second end of the changeover switch 5 is coupled to one of the first end of the second capacitive device 6 or the first end of the inductive device 7, so that when the changeover switch 5 is switched between the second capacitive device 6 and the inductive device 7, the radiation of different band signals may be implemented.

Further, since there is an electric field zero point in a radiating magnetic field of the first metal frame 1, the changeover switch 5 may be usually located at a position of a non-electric field zero point of the first metal frame 1 under a low-order mode and a high-order mode so as not to affect the operation of the changeover switch 5. For example, in some embodiments, the changeover switch 5 may be located at a center point of the first metal frame 1.

In an embodiment, the second end of the first capacitive device 4 is coupled to the first end of the changeover switch 5 through the first metal frame 1.

For example, the second end of the first capacitive device 4 is coupled to the first metal frame 1, and the first end of the changeover switch 5 is coupled to the first metal frame 1. Since the first metal frame 1 has conductivity, the second end of the first capacitive device 4 is coupled to the first end of the changeover switch 5 through the first metal frame 1.

In some embodiments, the second end of the first capacitive device 4 is coupled to the first metal frame 1 through an elastic piece, and the first end of the changeover switch 5 is coupled to the first metal frame 1 through an elastic piece.

Further, the second end of the first capacitive device 4 may be coupled to the first metal frame 1 through one or more elastic pieces, and the first end of the changeover switch 5 may also be coupled to the first metal frame 1 through one or more elastic pieces.

In some embodiments, the antenna can radiate in the band n77 in Sub-6 GHz. In this case, the above specified band may range from 1.1 GHz to 1.2 GHz. In this way, the length of the first metal frame 1 meets a quarter wavelength mode around the frequency range of 1.1 to 1.2 GHz, wherein the wavelength is the above specified band wavelength.

In an embodiment, a difference between the length of the first metal frame 1 and 30 mm is within a preset range, and the length of the second metal frame 2 ranges from 16 mm to 20 mm. That is, the length of the second metal frame 2 is usually required to meet a low-order mode resonance length of a high frequency portion from 2.3 GHz to 2.7 GHz.

The above preset range may be customized by the user according to actual demands, that is, the length of the first metal frame 1 may be set as about 30 mm.

Further, the first capacitive device 4 has a capacitance ranging from 0.5 pf to 2.5 pf. In an embodiment, in order to improve the radiation accuracy of the antenna, the first capacitive device 4 may be selected as an adjustable capacitor, so as to set the magnitude of a required capacitance value by adjusting the capacitance value of the adjustable capacitor during the implementation. For example, compared with a scenario where the changeover switch 5 is switched to be coupled to the second capacitive device 6, when the changeover switch 5 is switched to be coupled to the inductive device 7, the capacitance value of the first capacitive device 4 may be adjusted to be slightly larger.

Figure 4:
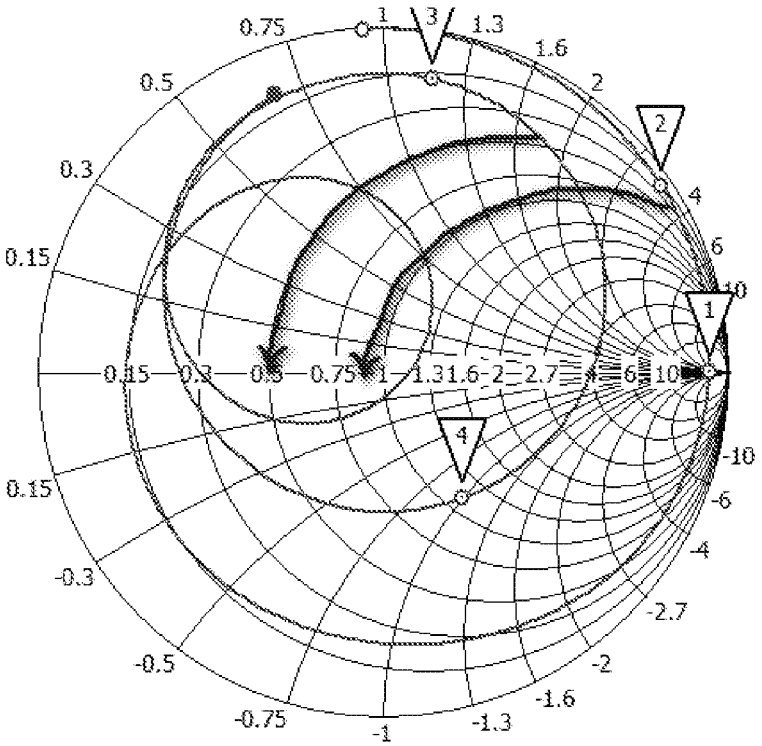
FIG. 4 is a Smith diagram according to an exemplary embodiment.

In the embodiments of the present disclosure, the position of the feeding point 3 is adjusted to be close to the tail end of the first metal frame 1. The length of the first metal frame 1 meets a quarter wavelength mode around a frequency range of 1.1 GHz to 1.2 GHz. In this case, according to a smith diagram in FIG. 4, it is shown that point mark1 corresponding to the frequency range of 1.1 GHz to 1.2 GHz falls on a smith zero axis, and a corresponding frequency point of 0.9 GHz falls around a 50 Ohm constant impedance circle in an inductive area, as shown in the position of point mark2 in the smith diagram. In this case, through a triple relation calculation, it is shown that a resonance frequency under a three-quarter wavelength mode of the first metal frame 1 approximately falls around the range of 3.3 GHz to 3.6 GHz, such as a range of mark3 to mark4 in the smith diagram. This segment also falls on and intersects with the 50 Ohm constant impedance circle. Therefore, when a first capacitive device with a smaller capacitance value is connected to the feeding point 3 in series, low frequency portions of 2G, 3G and 4G bands and a portion of Sub-6 GHz can be simultaneously drawn to be around 50 Ohm along the direction of an arrow, and two resonant modes are activated simultaneously. Thus, the radiation of various band signals may be implemented by using resonances under different wavelength modes corresponding to the first metal frame 1.

Further, since the width of the breaking joint may cause a certain influence on the antenna, in some embodiments, the width of the breaking joint between the first end of the first metal frame 1 and the second end of the second metal frame 2 may be set as 2 mm, so as to implement a good signal radiation.

It is to be noted that the first ground point, the second ground point, and the third ground point may be the same ground point or may also be different around points, which is not limited in the embodiments of the present disclosure.

The principle of radiating various band signals by the antenna will be described here. As described above, the first sub-antenna is formed based on the first metal frame 1, and the second sub-antenna is formed based on the first metal frame 2. When the changeover switch 5 is switched between the second capacitive device 6 and the inductive device 7, the radiation of different band signals may be implemented as follows.

When the changeover switch 5 is switched to be coupled to the second capacitive device 6, the first sub-antenna and the second sub-antenna are configured to radiate a low-and-medium frequency signal and a signal of a low frequency millimeter wave band. When the changeover switch 5 is switched to be coupled to the inductive device 7, the first sub-antenna and the second sub-antenna are configured to radiate a high frequency signal and the signal of the low frequency millimeter wave band.

Further, when the changeover switch 5 is switched to be coupled to the second capacitive device 6, a portion between a position where the second capacitive device 6 is located in the first sub-antenna and the breaking joint and the second sub-antenna are jointly configured to radiate a medium frequency signal, a resonance under a quarter wavelength mode of the first sub-antenna is configured to radiate a low frequency signal, and a resonance under a three-quarter wavelength mode of the first sub-antenna is configured to radiate the signal of the low frequency millimeter wave band. Alternatively, when the changeover switch 5 is switched to be coupled to the inductive device 7, a portion between a position where the inductive device 7 is located in the first sub-antenna and the breaking joint and the second sub-antenna are jointly configured to radiate a high frequency signal, a resonance under a three-quarter wavelength mode of the first sub-antenna is configured to radiate the signal of the low frequency millimeter wave band.

Figure 5:
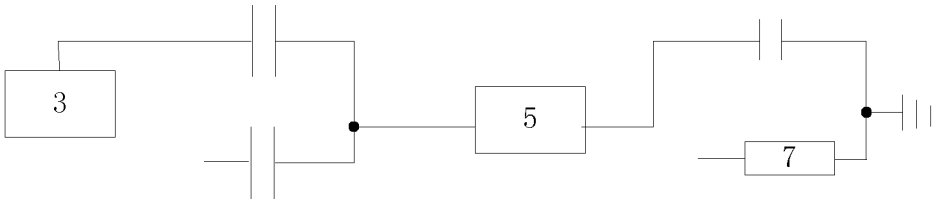
FIG. 5 is an equivalent circuit diagram according to an exemplary embodiment.
Figure 6:
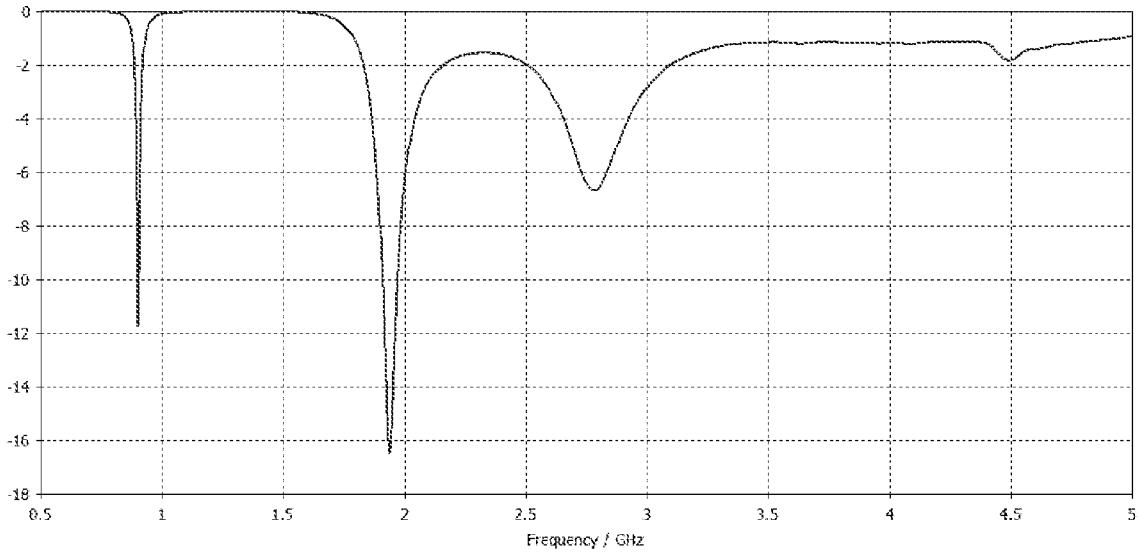
FIG. 6 is a schematic diagram of a signal return loss according to an exemplary embodiment.

When the changeover switch 5 is switched to be coupled to the second capacitive device 6, referring to FIG. 5, FIG. 5 is an equivalent circuit diagram according to an exemplary embodiment. In this case, a resonance under a quarter wavelength mode of the first sub-antenna is configured to radiate a low frequency signal, and a resonance under a three-quarter wavelength mode of the first sub-antenna is configured to radiate a signal of a Sub-6 GHz band. Referring to FIG. 6, FIG. 6 is a schematic diagram of a return loss of a radiated signal according to an exemplary embodiment. From FIG. 6, it can be seen that the first sub-antenna and the second sub-antenna in this case implement radiation of a low-and-medium frequency signal and a signal of a Sub-6 GHz band.

Figure 7:
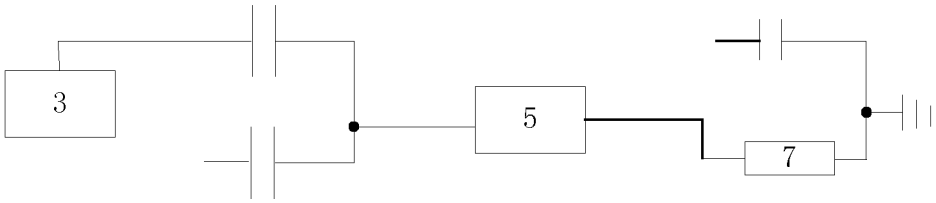
FIG. 7 is an equivalent circuit diagram according to an exemplary embodiment.
Figure 8:
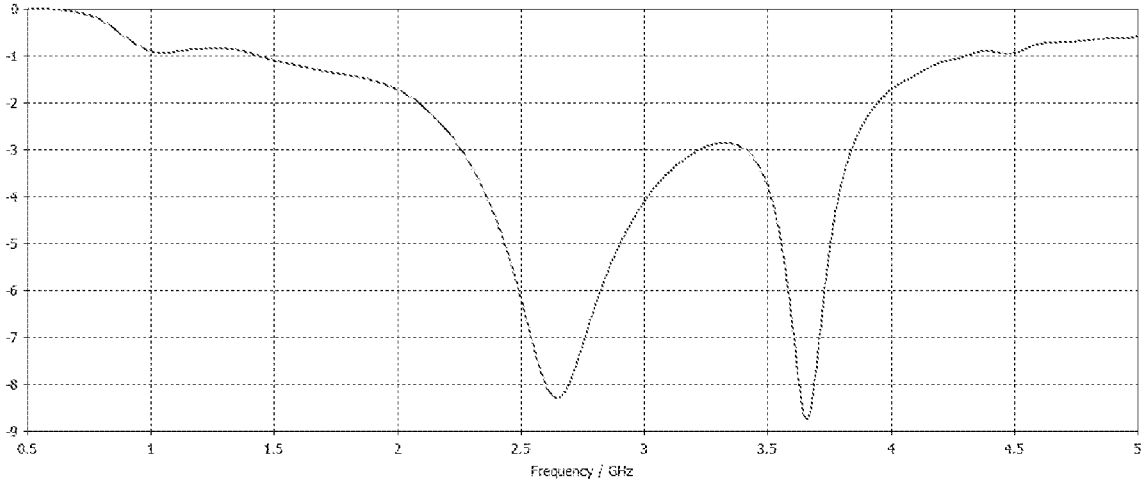
FIG. 8 is a schematic diagram of a signal return loss according to an exemplary embodiment.

When the changeover switch 5 is switched to be coupled to the inductive device 7, referring to FIG. 7, FIG. 7 is an equivalent circuit diagram according to an exemplary embodiment. In this case, a resonance under a three-quarter wavelength mode of the first sub-antenna is configured to radiate a signal of a Sub-6 GHz band. Referring to FIG. 8, FIG. 8 is a schematic diagram of a return loss of a radiated signal according to an exemplary embodiment. From FIG. 8, it can be seen that the first sub-antenna and the second sub-antenna in this case implement radiation of a high frequency signal and a signal of a Sub-6 GHz band.

It is also to be noted that the number of the changeover switch 5, the second capacitive device 6 and the inductive device 7 and the number of channel states will not be limited in the embodiments of the present disclosure. That is, since the Sub-6 GHz bands include a plurality of bands such as n77, n78 and n79, in some embodiments, a plurality of changeover switches 5, a plurality of second capacitive devices 6 or a plurality of inductive devices 7 may be provided, so as to implement radiation of signals of the different bands n77, n78 and n79. For example, when a signal of the band n77 is radiated, the capacitance value of the second capacitive device 6 is 2.7 pf, and the inductance value of the inductive device 7 is 8 n.

In the embodiments of the present disclosure, an antenna is provided, which is applied to a mobile terminal. The antenna is mainly implemented by a first metal frame and a second metal frame of the mobile terminal, a breaking joint being provided between the first metal frame and the second metal frame. A specified position of an end, close to the breaking joint, of the first metal frame includes a feeding point, the feeding point is coupled to a first capacitive device, the first capacitive device is coupled to a changeover switch, the changeover switch is coupled to a second capacitive device or an inductive device, the second capacitive device or the inductive device is coupled to a first ground point, and the first metal frame is coupled to a second ground point, so as to form a portion of the antenna. In addition, the second metal frame is coupled to a third ground point, so as to form another portion of the antenna. Since the length of the first metal frame is within the range of a quarter wavelength of a specified band, when the changeover switch is switched between the second capacitive device and the inductive device, the two portions of the antenna not only may implement radiation of the existing band signal, but also may implement radiation of a signal of a low frequency millimeter wave band by using a harmonic wave under a high-order mode of the first metal frame, that is, may also radiate a signal of a Sub 6 GHz band. In the embodiments of the present disclosure, the antenna implements radiation of various different band signals without the addition of other devices and antenna branches.

Other embodiments of the present disclosure will be apparent to those skilled in the art by considering the specification and implementing the present disclosure. The present disclosure is intended to cover any variations, purposes or adaptive changes of the present disclosure, and these variations, purposes or adaptive changes follow the general principle of the present disclosure and include common knowledge or customary technical means, not disclosed by the present disclosure, in the technical field. The specification and the embodiments are only regarded as being exemplary.

It will be appreciated that the present disclosure is not limited to a precise structure having been described above and shown in the drawings, and various modifications and changes may be made without departing from the scope thereof.

The technical solutions provided by the embodiments of the present disclosure may include the following beneficial effects.

The embodiments of the present disclosure provide an antenna, applied to a mobile terminal. The antenna is mainly implemented by a first metal frame and a second metal frame of the mobile terminal, a breaking joint being provided between the first metal frame and the second metal frame. A specified position of an end, close to the breaking joint, of the first metal frame includes a feeding point, the feeding point is coupled to a first capacitive device, the first capacitive device is coupled to a changeover switch, the changeover switch is coupled to a second capacitive device or an inductive device, the second capacitive device or the inductive device is coupled to a first ground point, and the first metal frame is coupled to a second ground point, so as to form a portion of the antenna. In addition, the second metal frame is coupled to a third ground point, so as to form another portion of the antenna. Since the length of the first metal frame is within the range of a quarter wavelength of a specified band, when the changeover switch is switched between the second capacitive device and the inductive device, the two portions of the antenna not only may implement radiation of the existing band signal, but also may implement radiation of a signal of a low frequency millimeter wave band by using a harmonic wave under a high-order mode of the first metal frame, that is, may also radiate a signal of a Sub 6 GHz band. In the embodiments of the present disclosure, the antenna implements radiation of various different band signals without the addition of other devices and antenna branches.

What is claimed is:

1. An antenna applied to a mobile terminal, wherein the mobile terminal includes a first metal frame and a second metal frame, a breaking joint being provided between a first end of the first metal frame and a first end of the second metal frame, a length of the first metal frame being within a range of a quarter wavelength of a specified band, and the length of the first metal frame being greater than a length of the second metal frame, the antenna comprising:

a first sub-antenna; and a second sub-antenna, wherein a feeding point located at a specified position of the first end of the first metal frame is coupled to a first end of a first capacitive device, a second end of the first capacitive device is coupled to a first end of a changeover switch, a second end of the changeover switch is coupled to one of a first end of a second capacitive device or a first end of an inductive device, each of a second end of the second capacitive device and a second end of the inductive device is coupled to a first ground point, and a second end of the first metal frame is coupled to a second ground point, so as to form the first sub-antenna; and a second end of the second metal frame is coupled to a third ground point, so as to form the second sub-antenna.

2. The antenna of claim 1, wherein the changeover switch is located at a center of the first metal frame.

3. The antenna of claim 1, wherein:

responsive to switching the changeover switch to be coupled to the second capacitive device, the first sub-antenna and the second sub-antenna are configured to radiate a low-and-medium frequency signal and a signal of a low frequency millimeter wave band; and responsive to switching the changeover switch to be coupled to the inductive device, the first sub-antenna and the second sub-antenna are configured to radiate a high frequency signal and the signal of the low frequency millimeter wave band.

4. The antenna of claim 3, wherein:

responsive to switching the changeover switch to be coupled to the second capacitive device, a portion between a position where the second capacitive device is located in the first sub-antenna and the breaking joint and the second sub-antenna are jointly configured to radiate a medium frequency signal, a resonance under a quarter wavelength mode of the first sub-antenna is configured to radiate a low frequency signal, and a resonance under a three-quarter wavelength mode of the first sub-antenna is configured to radiate the signal of the low frequency millimeter wave band; and responsive to switching the changeover switch to be coupled to the inductive device, a portion between a position where the inductive device is located in the first sub-antenna and the breaking joint and the second sub-antenna are jointly configured to radiate a high frequency signal, a resonance under a three-quarter wavelength mode of the first sub-antenna is configured to radiate the signal of the low frequency millimeter wave band.

5. The antenna of claim 1, wherein a difference between the length of the first metal frame and 30 mm is within a preset range, and the length of the second metal frame ranges from 16 mm to 20 mm.

6. The antenna of claim 1, wherein the first capacitive device has a capacitance ranging from 0.5 pf to 2.5 pf.

7. The antenna of claim 1, wherein both the first metal frame and the second metal frame are a bottom frame of the mobile terminal.

8. The antenna of claim 1, wherein the breaking joint between the first end of the first metal frame and the first end of the second metal frame has a width of 2 mm.

9. The antenna of claim 1, wherein the second end of the first capacitive device is coupled to the first end of the changeover switch through the first metal frame.

10. The antenna of claim 2, wherein a difference between the length of the first metal frame and 30 mm is within a preset range, and the length of the second metal frame ranges from 16 mm to 20 mm.

11. A mobile terminal, comprising:

a first metal frame and a second metal frame, a breaking joint being provided between a first end of the first metal frame and a first end of the second metal frame, a length of the first metal frame being within a range of a quarter wavelength of a specified band, and the length of the first metal frame being greater than a length of the second metal frame, wherein a feeding point located at a specified position of the first end of the first metal frame is coupled to a first end of a first capacitive device, a second end of the first capacitive device is coupled to a first end of a changeover switch, a second end of the changeover switch is coupled to one of a first end of a second capacitive device or a first end of an inductive device, each of a second end of the second capacitive device and a second end of the inductive device is coupled to a first ground point, and a second end of the first metal frame is coupled to a second ground point, so as to form a first sub-antenna of the mobile terminal; and a second end of the second metal frame is coupled to a third ground point, so as to form a second sub-antenna of the mobile terminal.

12. The mobile terminal of claim 11, wherein the changeover switch is located at a center of the first metal frame.

13. The mobile terminal of claim 11, wherein:

responsive to switching the changeover switch to be coupled to the second capacitive device, the first sub-antenna and the second sub-antenna are configured to radiate a low-and-medium frequency signal and a signal of a low frequency millimeter wave band; and responsive to switching the changeover switch to be coupled to the inductive device, the first sub-antenna and the second sub-antenna are configured to radiate a high frequency signal and the signal of the low frequency millimeter wave band.

14. The mobile terminal of claim 13, wherein:

responsive to switching the changeover switch to be coupled to the second capacitive device, a portion between a position where the second capacitive device is located in the first sub-antenna and the breaking joint and the second sub-antenna are jointly configured to radiate a medium frequency signal, a resonance under a quarter wavelength mode of the first sub-antenna is configured to radiate a low frequency signal, and a resonance under a three-quarter wavelength mode of the first sub-antenna is configured to radiate the signal of the low frequency millimeter wave band; and responsive to switching the changeover switch to be coupled to the inductive device, a portion between a position where the inductive device is located in the first sub-antenna and the breaking joint and the second sub-antenna are jointly configured to radiate a high frequency signal, a resonance under a three-quarter wavelength mode of the first sub-antenna is configured to radiate the signal of the low frequency millimeter wave band.

15. The mobile terminal of claim 11, wherein a difference between the length of the first metal frame and 30 mm is within a preset range, and the length of the second metal frame ranges from 16 mm to 20 mm.

16. The mobile terminal of claim 11, wherein the first capacitive device has a capacitance ranging from 0.5 pf to 2.5 pf.

17. The mobile terminal of claim 11, wherein both the first metal frame and the second metal frame are a bottom frame of the mobile terminal.

18. The mobile terminal of claim 11, wherein the breaking joint between the first end of the first metal frame and the first end of the second metal frame has a width of 2 mm.

19. The mobile terminal of claim 11, wherein the second end of the first capacitive device is coupled to the first end of the changeover switch through the first metal frame.

20. The mobile terminal of claim 12, wherein a difference between the length of the first metal frame and 30 mm is within a preset range, and the length of the second metal frame ranges from 16 mm to 20 mm.

* * * * *